US005485916A

United States Patent [19]

Dean

[11] Patent Number: 5,485,916

[45] Date of Patent: Jan. 23, 1996

[54] COLLATING STRUCTURE

[76] Inventor: Carl A. Dean, 3824 Garfield St., Carlsbad, Calif. 92008

[21] Appl. No.: 199,517

[22] Filed: Feb. 22, 1994

[51] Int. Cl.[6] ..... B65D 85/00; B65D 5/50; B65D 25/10

[52] U.S. Cl. ..... 206/215; 206/45.19; 206/449; 211/50; 229/120.37

[58] Field of Search ..... 206/215, 449, 206/555, 499, 45.18, 45.19; 211/50, 59.4; 229/120.37

[56] References Cited

U.S. PATENT DOCUMENTS

| | | | |
|---|---|---|---|
| 1,592,922 | 7/1926 | Burnham | 206/45.18 |
| 1,656,379 | 1/1928 | Lee, Jr. | 206/215 |
| 1,782,915 | 11/1930 | Weidner | 229/120.37 X |
| 1,798,406 | 3/1931 | Dunn | 229/120.37 |
| 1,871,617 | 8/1932 | King | 206/449 X |
| 1,917,349 | 7/1933 | Wilmath | 206/45.18 X |
| 2,047,033 | 7/1936 | Ringler | 229/120.37 X |
| 2,207,917 | 7/1940 | Fleisher | 206/215 X |
| 2,425,895 | 8/1947 | Overly | 206/215 |
| 2,457,812 | 1/1949 | Epps | 206/45.18 X |
| 2,476,102 | 7/1949 | Lobell | 206/45.18 X |
| 2,478,635 | 8/1949 | Overly | 206/215 |
| 2,551,390 | 5/1951 | Overly | 206/215 |
| 3,055,494 | 9/1962 | Hepp | 206/45.19 |
| 3,182,792 | 5/1965 | Viltrakis | 206/449 |
| 3,963,167 | 6/1976 | Newgaard, II | 229/120.37 X |
| 3,973,674 | 8/1976 | Postlewaite | 206/215 |

*Primary Examiner*—Bryon P. Gehman
*Attorney, Agent, or Firm*—John J. Murphey; Murphey Law Offices

[57] ABSTRACT

A foldable insert to collate an open box for receipt, withdrawal and reinsertion of two separate stacks of stationary items, the box defined by a flat base of overall rectangular shape having a pair of vertical end walls held in spaced-apart arrangement by a pair of vertical side walls, all attached through devices that define the rectangular periphery thereof, the insert including a narrow display portion extending transverse to the ends of the box defined by a pair of spaced-apart elongated side edges and a pair of shorter end edge, a first support section extending from one of the elongated side edges toward one end of the box for passing under one stack of items, including an upwardly directed support portion, a second support section extending from the opposite elongated side edge of the display portion reversibly down under the display portion and then toward the other end of the box for passing under the second stack of items, including an upwardly sloping portion to angle the items upward toward the other end of the box, and the first and second support sections hingedly interconnected for supporting the display portion transverse to the support sections and co-planar with the top of the box.

20 Claims, 2 Drawing Sheets

COLLATING STRUCTURE

BACKGROUND OF THE INVENTION

1. Field of the Invention

This invention relates to improvements in the box and package industry. More particularly, it pertains to a unique structure to display and hold stationary items and envelopes in which to post them, in different areas of a box, separated by an integral display section on which to print or otherwise display information concerning the contents.

2. Description of the Prior Art

Numerous items in our commercial world are shipped from the manufacturer to the retailer in boxes, where the contents are removed and positioned on display shelves, and then sold separately to the consumer. Boxes used to ship the items to the retailer are often discarded and burned or otherwise destroyed. In some industries this destruction of shipping containers represents a significant waste of resources. For instance, in the paper-based industry, most cartons in which stationary items such as greeting cards, envelopes, are packaged are made of cardboard representing numerous trees that have been cut and processed. To destroy these tree-based products before using them further represents a short-sighted approach to the conservation of natural resources.

In some instances, the stationary items are shipped and displayed to the consumer in their boxes. While this represents an effort to utilize the carton further down the line of commercial enterprise, certain difficulties have been encountered making use of the carton rendering such practice unsatisfactory to the consumer. In many cases, the stationary items, such as greeting cards are boxed with the envelopes in which to post them in a vertical stack with the envelopes on the bottom and the cards on the top. While this allows display of the cards to the user and easy withdrawal from the top of the open box, one has to reach under the stack to extract the envelope. This often leads to the box being tipped over resulting in the cards and envelopes being spilled on the floor and the consumer frustrated. While the cards and envelopes may be presented stacked on edge, the face of the card is hidden from view and the consumer fails to appreciate the beauty of the cards presented this way.

In addition, in the case of many boxed cards, information as to the quantity, price, author, and other marketing data are required before the consumer is fully appraised of sufficient facts on which to make an informed judgment about the product. As most card boxes are made of brown cardboard and manufactured in huge quantities at a distant factory and it is inappropriate to print such specific information at a distant factory, it is inappropriate to print such specific information on the carton. In those cases, a separate price insert must be made, printed and physically placed in the box of cards.

The prior art has attempted to correct this situation by fashioning a variety of display aids with which to use in presenting the cards and envelopes to the public. For the most part, however, this has resulted in the need for separate articles to be used in conjunction with the card box, requiring more material and the cutting and processing of more trees, with the attendant costs of labor and other factors.

SUMMARY OF THE INVENTION

This invention is a unique structure which performs various tasks in the handling of stationary items and envelopes to eliminate the problems heretofore described in the prior art or at least which reduces the problems to manageable proportions. It may be used as an insert or a complete box, without the need for separate inserts to provide the public with needed market information while, at the same time, displaying and collating the stationary items and envelopes for easy extraction from and reinsertion into the box.

This invention is a foldable insert to collate an open box of stationary items and envelopes for removal from separate areas from the box that contains an integral display section on which needed market information may be displayed. In one embodiment of the invention the insert may be placed in the box to present the cards and envelopes in easy-to-extract and re-insert arrangement, while in another embodiment, the insert is foldable to form the entire box, complete to collate and allow presentation of and display marketing information about the cards and envelopes, all coverable by a separate box lid. In both cases, the effect is the same, namely, more versatility is provided to the retailer in marketing the cards while strain is reduced on our natural resources.

Accordingly, the main object of this invention is a collating structure for stationary items and the envelopes in which to post them that displays the items and envelopes separately and in easily extractable and re-insertable form. Other objects include a structure that maintains greeting cards, and other stationary items totally separate from each other; to separate cards and envelopes in the box and contain them without any damage to their configuration; an insert that presents the cards and envelopes in an easy-to-extract and re-insert format for use by the consumer eliminating the existing problems associated with extracting an envelope totally hidden under a stack of cards; an insert that has a display section integral therewith for presenting marketing information such as quantity, price and other facts so as to eliminate the extra job of printing an extra insert and folding and inserting it into each box of cards; a box having a collating means integral therewith, including a display section co-planar with the open top thereof, that collates and presents the cards and envelopes for convenient viewing by the prospective purchaser and easy extraction and re-insertion by the user. These and other objects of the invention will become apparent when reading the Description of the Preferred Embodiments taken together with the drawings appended hereto. The scope of protection desired by the inventor may be gleaned from a fair reading of the claims that conclude this Specification.

DESCRIPTION OF THE PREFERRED EMBODIMENTS

Figure 1:
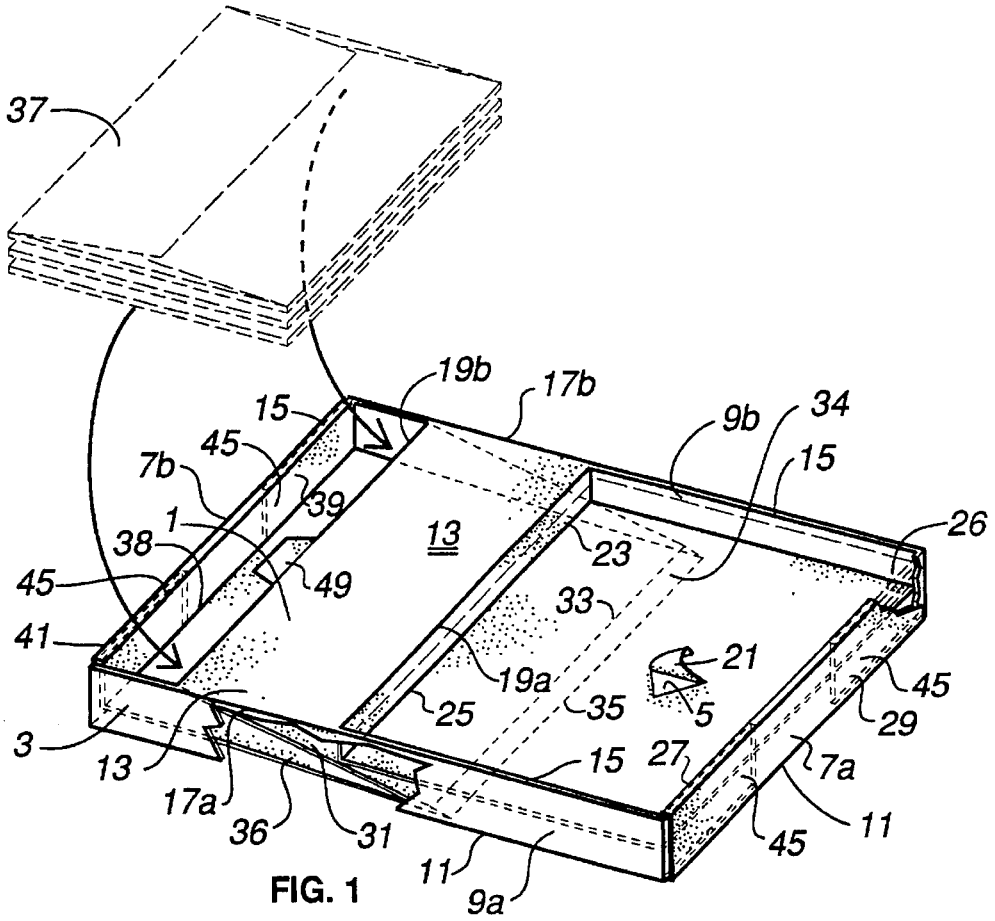
FIG. 1 is an illustrative view of the preferred embodiment of the invention designed as an insert to be dropped into a coverless existing box for use in collating the stationary and envelopes.
Figure 2:
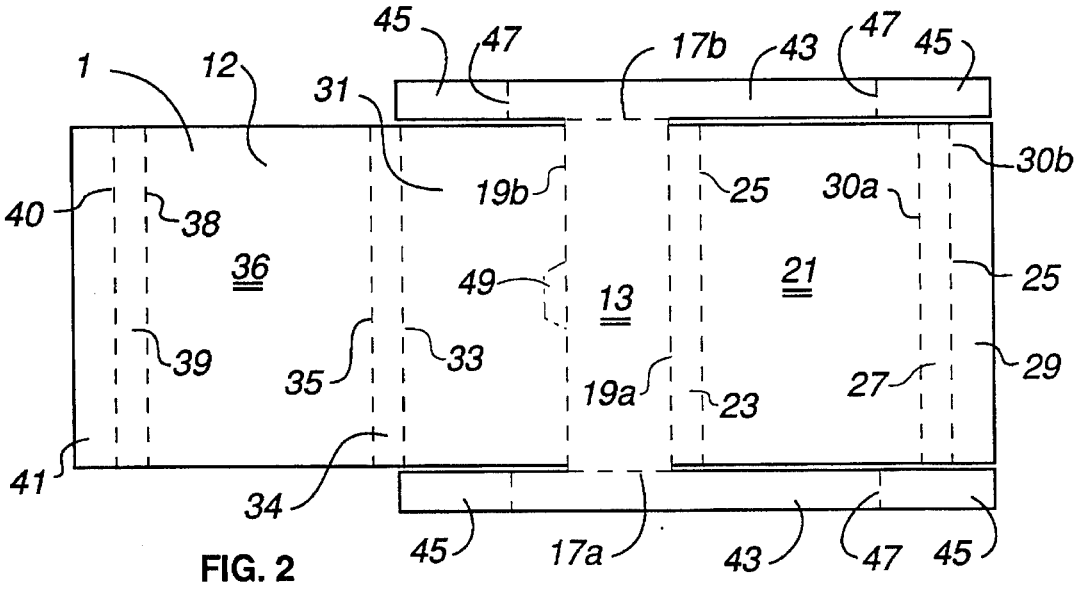
FIG. 2 is a top plan view of the insert shown in FIG. 1 unfolded showing the fold lines and other features thereof.

Referring now to the drawings, wherein like elements are referred to with like numerals throughout the five figures, FIG. 1 shows one embodiment of this invention wherein the inventive structure 1 is shown positioned in a box 3, the box generally constructed of cardboard or heavy paper and is defined by a flat base 5 of overall rectangle shape having a pair of vertical end walls 7*a* and 7*b*, forming the ends of the box, held in spaced-apart arrangement by a pair of vertical side walls 9*a* and 9*b*, forming the sides of the box, all attached either through attachment means such as glue, staples or the like, but preferably merely upward extensions of base 5 made along fold lines 11 that define the rectangle periphery of said box. The box designed to display and collate various separate items of a stationary character. By "collate" is meant that the items are housed separately in one box and presented for removal therefrom or re-insertion in separate areas of the box. This is in contrast to the standard practice of placing one item, such as an envelope, under the greeting cards to totally hide them from the user and require the user to reach underneath the top stack in order to obtain one, as hereinbefore described.

This invention is shown in the form of an insert 12 to be dropped into open box 3 and to comprise in combination a narrow display portion 13 extending between side walls 9*a* and 9*b* and coplanar or coincident with the plane formed by the top marginal edges 15 of box 3. Display portion 13 is generally made about two inches wide and on which such marketing information is printed such as the description of the items, the number of each of them in a box, the model or trademark applied to the goods, and the trade name of the artisan who made the goods. Because the insert is small, it is easy to print with this information and is easily acceptable in most printing machines. Display portion 13 fits transverse to box side walls 9*a* and 9*b* and is defined by a pair of mutually spaced-apart elongated side edges 19*a* and 19*b* and a pair of mutually spaced-apart shorter end edges 17*a* and 17*b*, that may be mere edges or fold lines as hereinafter set forth.

A first support floor 21 extends from the bottom of a support wall 23, interposed display portion 13 by a fold line located at edge 19*a* and a parallel fold line 25 spaced apart therefrom, toward box end 7*a* to support a stack 26 of items thereon such as greeting cards. Support floor 21 is held in place by upwardly extending support wall 27 and reverse folded flap 29 formed by a set of fold lines 30*a* and 30*b* that passes over top marginal edge 15 of box 3. It is preferred that floor 21 lie spaced above box base 5.

A second support section 31 extends from display portion 13 opposite edge 19*b* downward and rearward under display portion 13 and partially under floor 21 to a first fold line 33 where it angles further downward through a transition area 34 toward box base 5 to a second fold line 35 lying near or, in some cases, in actual contact with the inside surface of base 5. Section 31 then extends back upward as a support floor 36 for a second stack 37 of items, such as envelopes for the greeting cards, at an angle toward box end 7*b* where it passes through another transverse fold line 38 to change to a more sharply rising floor for support by an upwardly extending support wall 39 and reverse folded flap 41, bent at fold line 40, that passes over top marginal edge 15 of box 3.

Optionally, a pair of elongated side tabs 43 may be provided extending outward from display portion end edges 17*a* and 17*b* and along the edges of insert 12 to be folded downward along edges 17*a* and 17*b* (now serving as fold lines) and the ends 45 folded along fold lines 47 and inserted between support wall 27 and flap 29, at one end of box 3, and inserted between support wall 39 and flap 41 at the other end of box 3 to provide additional support and rigidity to insert 12.

As shown in FIG. 1, stack 37 of items are kept in under lapping arrangement with stack 26 of items; in fact, stack 37 is held in under lapping arrangement below stack 26 to allow box 3 to be constructed in shorter length than if the separate stacks were not kept in such relationship. Finally, at least one exposed tab 49 (shown in dotted outline) may optionally be formed out of second support section 31 to extend outward, co-planar with the surface of display portion 13, to aid in holding the top of stack 37 of stationary items in its respective location. Tab 49 does not extend into any slits or other receptacle.

Figure 3:
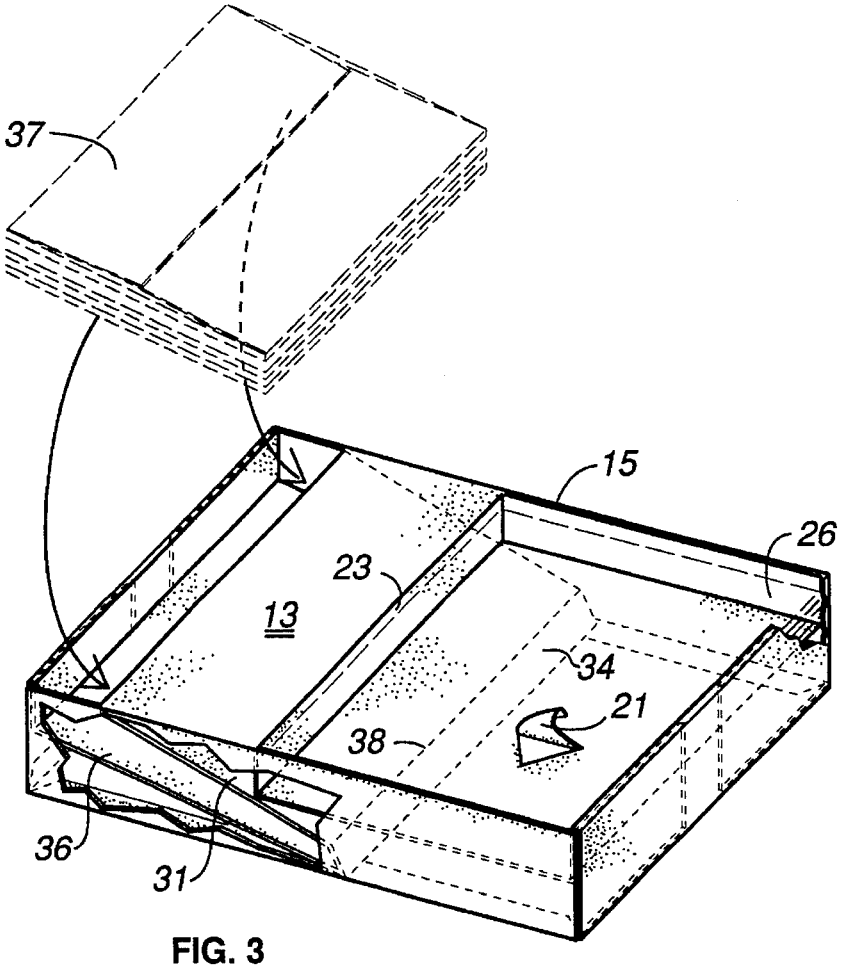
FIG. 3 is an illustrative view of a second embodiment of the invention formed into an entire box for collating the cards and envelopes; and, FIG. 4 is a top plan view of the box shown in FIG. 3 in its flat, unfolded configuration.
Figure 4:
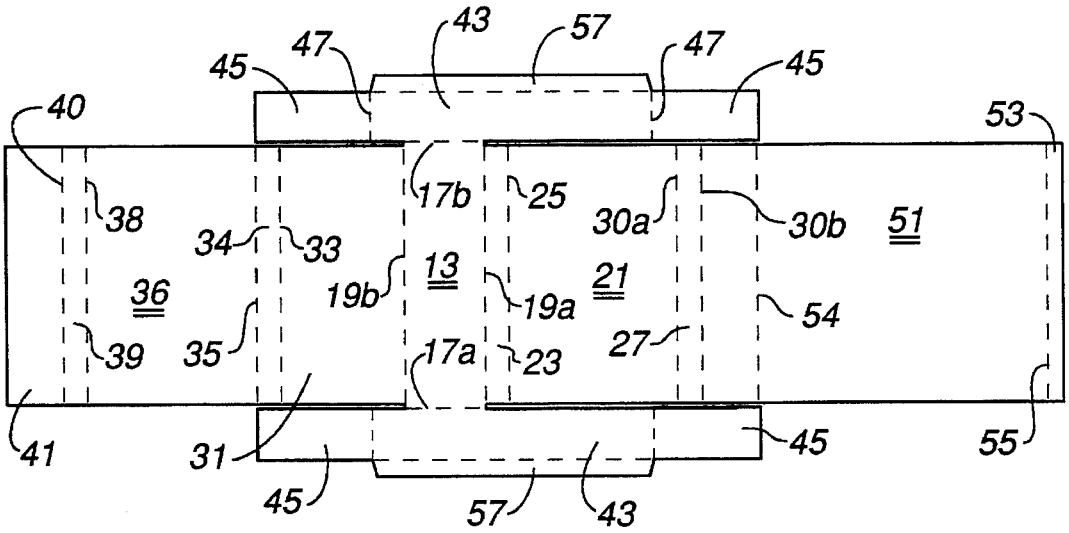

Another embodiment of this invention is shown in FIGS. 3 and 4 where a complete open-top box is formed from a single planar sheet of material that may be easily die-stamped and formed to also collate these stationary items, such as cards and envelopes, for removal from separate areas and re-insertion through the top thereof. In this embodiment, identifying numerals from the first embodiment will remain the same.

In this embodiment there is no underlying box 3. An additional flap 51 extends from flap 29 and terminates in a narrow glue flap 53. Flap 51 is folded under support floor 21 at fold line 54 and form the base of the box; glue flap 53 is bent upward at fold line 55 and glued or otherwise attached on the inside or outside of flap 41 to join box base 51 to opposite wall flap 41. A pair of narrow glue flaps 57 extend outward from elongated tabs 43 and are also glued or otherwise attached to flap 51 to join side walls (flaps) 43 to new box base (flap) 51.

By judiciously locating the fold lines, especially 17*a*, 17*b*, one can place narrow display portion at various locations along the top of the box and may even change the width thereof to be able to place more or less information on said portion.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve the same results are within the scope of this invention.

What is claimed is:

1. A foldable insert to collate an open top box for receipt, withdrawal and reinsertion of first and second separate stacks of stationery items therein, the box defined by a flat, horizontal base of overall rectangular shape having a pair of vertical end walls, defining the ends of the box, and a pair of vertical side walls, defining the sides of the box, the end walls and the side walls surrounding the base and attached thereto through means that define the periphery thereof and having common upper side edges atop said side and end walls forming a top marginal edge spaced above and parallel to said base, said insert comprising:

a) a narrow, horizontal planar display portion, defined by a pair of mutually spaced-apart elongated side edges and a pair of mutually spaced-apart shorter end edges, for placement in the box at the level of said top marginal edge wherein said end edges would lie parallel to the side edges of the box;

b) a first support section extending from one of said elongated side edges for positioning on the base of the box for extending under a said first stack of stationery items and retaining it in horizontal presentation above the base; and, c) a second elongated support section extending from said other elongated side edge of said display portion beneath said display portion and under a second said stack of stationery items, to separate the second stack from the first stack, said second elongated support section including an upwardly sloping portion to angle the second stack of items upward at one end thereof;

d) said first and second support sections hingedly connected to said display portion for supporting said display portion co-planar with the top of the box.

2. The foldable insert of claim 1 wherein said second support section includes a transition area under said first support portion.

3. The foldable insert of claim 1 wherein said second support section is angled downward.

4. The foldable insert of claim 1 wherein said upwardly sloping portion of said second support section is braced upward by an extension thereof folded upwardly and then reverse folded downwardly.

5. The foldable insert of claim 1 wherein said second support section resides in partial underlapping arrangement with said first support section.

6. The foldable insert of claim 1 wherein said first support section resides in partial overlapping arrangement above said second support section.

7. The foldable insert of claim 1 further including a pair of side tabs extending outward from said end edges of said display portion to be folded downward to form vertical support walls for said display portion.

8. The foldable insert of claim 1 further including a pair of elongated tabs extending outward from said display portion end edges and along said insert for folding downward and including end flaps that may be folded inward therefrom to provide rigidity to said insert.

9. The foldable insert of claim 1 wherein said display portion is supported by at least one support wall interconnected by one of said elongated side edges.

10. The foldable insert of claim 9 further including at least one tab extending outward from said elongated side edge of said display portion and co-planar therewith to aid in holding one of the stacks of stationary items in its respective location.

11. In combination, an open-top box, defined by a flat base of overall rectangular shape having a pair of vertical end walls, defining the ends of said box, a pair of vertical side walls, defining the sides of said box, said end walls and said side walls surrounding said base and attached thereto through means that define the periphery thereof, and a foldable element to collate first and second separate stacks of stationery items carried therein for receipt, withdrawal and reinsertion, said element comprising:

a) a narrow, horizontal planar display portion, defined by a pair of mutually spaced-apart elongated side edges and a pair of mutually spaced-apart shorter end edges, at the level of said top marginal edge wherein said end edges are parallel to said side edges of said box;

b) a first support section extending from one of said elongated side edges for positioning on the base of said box for extending under a first said stack of stationery items and retaining it in horizontal presentation above the base; and, c) a second elongated support section extending from said other elongated side edge of said display portion beneath said display portion and under a second said stack of stationery items, to separate the second stack from the first stack, said second elongated support section including an upwardly sloping portion to angle the second stack of items upward at one end thereof;

d) said first and second support sections hingedly connected to said display portion for supporting said display portion co-planar with the top of said box.

12. The combination of claim 11 wherein said second support section includes a transition area under said first support portion.

13. The combination of claim 11 wherein said second support section is angled downward.

14. The combination of claim 11 wherein said upwardly sloping portion is braced upward by an extension thereof folded upwardly and then reverse-folded downwardly.

15. The combination of claim 11 wherein said second support section resides in partial underlapping arrangement with said first support section.

16. The combination of claim 11 wherein said second support section resides in partial overlapping arrangement with said first support section.

17. The combination of claim 11 wherein said display portion is supported by at least one vertical support wall interconnected by said elongated side edges of said display portion.

18. The combination of claim 17 further including at least one exposed tab formed out of one of said support walls and extending outward from said elongated side edge of said display portion and co-planar therewith to aid in holding one of the stacks of stationery items in its respective location.

19. The combination of claim 11 further including a pair of side tabs extending outward from said end edges of said display portion for folding downward to form a wall in parallel relationship adjacent said vertical walls forming said sides of said box.

20. The combination of claim 11 further including a pair of elongated tabs extending outward from said end edges of said display portion for folding downward and including end flaps to provide rigidity to said combination.

* * * * *